US008881438B2

(12) United States Patent
Shimizu et al.

(10) Patent No.: US 8,881,438 B2
(45) Date of Patent: Nov. 11, 2014

(54) LUGGAGE TAG

(71) Applicants: Ryoichi Shimizu, Tokyo (JP); Yukie Sahara, Tokyo (JP)

(72) Inventors: Ryoichi Shimizu, Tokyo (JP); Yukie Sahara, Tokyo (JP)

(73) Assignee: Hitachi Systems, Ltd., Tokyo (JP)

( * ) Notice: Subject to any disclaimer, the term of this patent is extended or adjusted under 35 U.S.C. 154(b) by 0 days.

(21) Appl. No.: 13/723,837

(22) Filed: Dec. 21, 2012

(65) Prior Publication Data

US 2014/0173951 A1 Jun. 26, 2014

(51) Int. Cl.
*G09F 3/00* (2006.01)

(52) U.S. Cl.
CPC ..... *G09F 3/0288* (2013.01)
USPC ..... 40/6; 283/80

(58) Field of Classification Search
USPC ..... 40/6; 283/80
See application file for complete search history.

(56) References Cited

U.S. PATENT DOCUMENTS

| | | | | |
|---|---|---|---|---|
| 4,726,131 | A * | 2/1988 | Cass | 40/638 |
| 4,817,310 | A * | 4/1989 | Breen et al. | 40/6 |
| 4,882,861 | A * | 11/1989 | Holmes et al. | 40/6 |
| 5,318,817 | A * | 6/1994 | Ohno et al. | 428/41.3 |
| 5,366,249 | A * | 11/1994 | Diemert | 283/80 |
| 5,395,667 | A * | 3/1995 | Ohno et al. | 428/41.3 |
| 5,670,225 | A * | 9/1997 | Yamanaka et al. | 428/40.1 |
| 5,707,082 | A * | 1/1998 | Murphy | 283/67 |
| 6,303,201 | B1 | 10/2001 | Baierl et al. | |
| 8,167,336 | B2 * | 5/2012 | Minor et al. | 283/80 |
| 8,567,674 | B2 * | 10/2013 | Conaghan et al. | 235/384 |
| 2011/0082810 | A1 * | 4/2011 | Holtz-Davis et al. | 705/330 |
| 2013/0219759 | A1 * | 8/2013 | Kimes | 40/6 |
| 2013/0221081 | A1 * | 8/2013 | Conaghan et al. | 235/3 |

FOREIGN PATENT DOCUMENTS

| | | | |
|---|---|---|---|
| JP | 7-56513 | A | 3/1995 |
| JP | 2008-299603 | A | 12/2008 |
| JP | 2012-063446 | | 3/2012 |
| WO | 86/05303 | | 9/1986 |

OTHER PUBLICATIONS

European Search Report for EP 12 29 0462 dated May 27, 2013.
Office Action and English Translation received in the corresponding Korean Application 10-2012-0152123 dated Jan. 27, 2014.
Singapore Search Report and Written Opinion for Application Serial No. SG 201209505-5 dated Oct. 9, 2013.

* cited by examiner

*Primary Examiner* — Charles A Fox
*Assistant Examiner* — Shin Kim
(74) *Attorney, Agent, or Firm* — McCormick, Paulding & Huber LLP

(57) ABSTRACT

A luggage tag which can be easily operated for attachment of the luggage tag to a luggage is provided. A luggage tag includes a surface sheet and a peel-off sheet, and a customer's copy is provided on one end portion of the surface sheet via a separation slit. A peel-off region is provided on one end portion of the peel-off sheet via a peel-off slit. When winding the luggage tag on a handle of a luggage in a loop fashion, an attaching portion to be adhered to the peel-off sheet is covered with the peel-off region, and the customer's copy is adhered to the peel-off region. A folding line is provided on the peel-off region, and when the peel-off region is folded along the folding line, an adhesive layer of the customer's copy is exposed outside.

5 Claims, 7 Drawing Sheets

LUGGAGE TAG

TECHNICAL FIELD OF THE INVENTION

The present invention relates to a luggage tag on which luggage information such as a destination or a flight number of a flight luggage is written and which is attached to the luggage so as to be used as a label upon transportation or delivery of the luggage.

BACKGROUND OF THE INVENTION

When an airplane passenger checks his/her luggage to an airline carrier, a band-like luggage tag on which luggage information such as a destination of a luggage or a flight number of a flight is used. The luggage tag is attached to a luggage at a luggage-delivery counter in an airport terminal, and transportation and delivery services of the luggage are provided according to information written on the luggage tag. As the luggage tag, a type to be attached to a handle of a luggage in a loop fashion has been proposed.

Japanese Patent Application Laid-Open Publication No. 7-56513 (Patent Document 1) describes a luggage tag having a band-like tag main body and a heat-sealed base material provided on a back face of the tag. The luggage tag is attached to the handle by heating the heat-sealed base material in a state that the tag main body has been wound on a handle of a luggage in a loop and portions of the heat-sealed base material on a back face of the loop have been on top of each other by such a heating unit utilizing ultrasonic heating, high-frequency heating, or the like.

Japanese Patent Application Laid-Open No. 2008-299603 (Patent Document 2) describes a luggage tag having a base material sheet on which a non-contact IC module having an IC chip and a communication antenna attached to the base material sheet, and a peel-off sheet which is adhered to the base material sheet by an adhesive layer of the base material sheet. Both end portions of the peel-off sheet can be peeled off at slit portions, and the luggage tag is attached to a handle of a luggage by winding the luggage tag on the handle, removing the both end portions of the peel-off sheet, and causing adhesive layers to be exposed to adhere to each other.

SUMMARY OF THE INVENTION

As described in Patent Document 1, when such a configuration is adopted that the heat-sealed base materials are adhered to each other using a heating apparatus utilizing ultrasonic heating or the like, a heating apparatus is required in order to attach the luggage tag to a luggage, which results in not only reduction of attaching workability of a tag but also introduction of an operator-attaching system by which an operation for attaching a tag to a luggage is performed by only a specialized operator. On the other hand, as described in Patent Document 2, adoption of such a configuration that the peel-off sheet is removed results in introduction of a self-attaching system by which a tag can be attached to a luggage by not only an operator but also a luggage owner himself/herself.

In the self-attaching system, however, since the luggage owner himself/herself attaches a luggage tag to his/her luggage, such a case occurs that a luggage owner less attuned to the attaching operation of a tag attaches a tag. Therefore, it is preferable that the luggage tag for the self-attaching system can be attached to a luggage by a simpler operation. Further, if such a configuration is adopted that the peel-off sheet can be partially removed in order to expose the adhesive layer of a surface sheet, such a problem occurs that the removed portion of the peel-off sheet ends up in the garbage. When the portions which have been removed to become unnecessary are discarded carelessly, they make a surrounding area of a luggage counter dirty.

In view of these circumstances, research and development have been made to achieve a luggage tag configured such that the luggage tag can be attached to the luggage according to a simple operation even by a luggage owner less attuned to a tag-attaching operation while a portion of the luggage tag which should be discarded upon attaching the luggage tag to a luggage is reduced.

In a luggage tag including a surface sheet having an outer face on which luggage information is written and a peel-off sheet which is adhered to an adhesive layer provided on an inner face of the surface sheet, when the luggage tag is attached to a handle of a luggage, the peel-off sheet is partially peeled off to expose the adhesive layer on the inner face of the surface sheet. It takes time for a worker less attuned to a tag-attaching operation to peel off a portion of the peel-off sheet corresponding to the handle of the luggage and next attaching the portion exposed after the peeling-off to a specific portion so that the luggage tag is attached to the luggage. In addition, in such a structure that a portion of the peel-off sheet which has been peeled off in order to expose the adhesive layer must be discarded, waste is produced.

To prevent the luggage tag which has been attached in the loop fashion from being detached from the luggage during loading work and transportation of the luggage, it is necessary to attach the portion of the adhesive layer being exposed by peeling the peel-off sheet partially to a predetermined position on a back face of the tag. However, when the self-attaching system is adopted like a case where a customer himself/herself who is a luggage owner attaches a luggage tag to his/her luggage, if a user less attuned to a tag operation performs the tag-attaching operation, the adhesive layer may be attached to a position deviated from a predetermined position. If a loading work of the luggage or the like is performed in such a state that the adhesive layer has not been attached to the predetermined position, the tag may be detached from the luggage.

A preferred aim of the present invention is to provide a luggage tag which can be operated easily when attaching it to a luggage.

A first aspect of the present invention is a luggage tag to be attached to a luggage, the luggage tag including: a surface sheet in a belt-like shape having an outer face on which luggage information is printed and an inner face having an adhesive layer; and a peel-off sheet in a belt-like shape detachably adhered to the adhesive layer, in which a customer's copy which is separated at a separation slit from a surface main body portion of the surface sheet is provided on one end portion of the surface sheet; a plurality of airline carrier's copies, which are peeled off from the peel-off sheet and are separated from the surface main body portion, are provided on the other end portion of the surface sheet; a peel-off region separated from a peel-off main body portion of the peel-off sheet at a peel-off slit, and peeled off from an attaching portion provided on the surface main body portion so as to be adhered to the peel-off sheet when winding the surface main body portion on a handle of the luggage in a loop fashion is provided on one end portion of the peel-off sheet while the customer's copy is being adhered to the peel-off region; and a folding line for sectioning the peel-off region into an adhesive portion to be adhered to an adhesive layer of the customer's copy and an exposed portion to be exposed is provided in the peel-off region, so that the adhesive layer of the customer's copy is exposed by folding the peel-off region at the folding line that is taken as a boundary.

A second aspect of the present invention is the luggage tag according to the first aspect, in which the other end portion of the peel-off sheet is defined as a remaining portion, a removal slit for sectioning the peel-off sheet into the remaining portion and the peel-off main body portion is provided in the peel-off sheet, and the peel-off main body portion is removed from the surface sheet when the surface sheet is attached to the luggage. A third aspect of the present invention is the luggage tag according to the first or second aspect, in which a projecting portion, which is curved so as to project toward the peel-off main body portion from both end portions of the peel-off slit, is provided on a central portion of the peel-off slit in a longitudinal direction of the peel-off slit, and the projecting portion is peeled off from the attaching portion when the luggage tag is folded along the both end portions of the peel-off slit so that the peel-off sheet is positioned outside. A fourth aspect of the present invention is the luggage tag according to any one of the first to third aspect, in which a peel-off indication mark indicating the position of the peel-off slit is provided on the peel-off sheet. A fifth aspect of the present invention is the luggage tag according to any one of the first to fourth aspect, in which corner portions of the customer's copy positioned on the surface main body portion side and corner portions of the surface main body portion positioned on the customer's copy side are formed in an arc shape, respectively.

According to the present invention, when the peel-off region of the peel-off sheet is peeled off from the surface sheet, the customer's copy is adhered to the peel-off region and the luggage tag is sectioned into a portion to be attached to the luggage and a portion kept by a luggage owner. When the customer's copy to be kept by the luggage owner is separated from the surface sheet, the attaching portion of the surface sheet is exposed to the outside. When the attaching portion being exposed is adhered to the peel-off sheet, the luggage tag is attached to the handle of the luggage.

When the peel-off region is peeled off from the surface sheet and the peel-off main body portion is peeled off from the surface sheet, the adhesive layer provided on the surface sheet is exposed being boarder than the attaching portion. Thus, when attaching the exposed adhesive portion to a side face of the luggage, attachment of the luggage tag is completed in a state where the luggage tag is being attached to the luggage. In this state, since there is a remaining portion of the luggage tag, the luggage tag can be easily removed from the luggage by grasping the remaining portion when the luggage tag becomes unnecessary.

When a user keeps the customer's copy attached to the peel-off region of the peel-off sheet peeled off from the surface sheet, the user can attach the customer's copy to one of user's belongings by folding the peel-off region at a portion of the folding line to expose a portion of the adhesive layer of the customer's copy outside. Thereby, the user can be prevented from losing the customer's copy which is relatively small-sized.

BRIEF DESCRIPTIONS OF THE DRAWINGS

DESCRIPTIONS OF THE PREFERRED EMBODIMENTS

An embodiment of the present invention will be described in detail with reference to the drawings. As illustrated in FIG. 1, a luggage tag 1 has a band-like surface sheet 20 having an outer face on which luggage information is written and an inner face to which an adhesive layer 10 is adhered, and a band-like peel-off sheet 30 detachably adhered to the adhesive layer 10 of the surface sheet 20. Thus, the luggage tag 1 has a three-layered structure formed of the surface sheet 20 serving as an upper sheet, the adhesive layer 10 provided on an inner face of the surface sheet 20, and the peel-off sheet 30 adhered to the inner face, namely, a back face, of the surface sheet 20 as a lower sheet. The surface sheet 20 having the inner face applied with the adhesive layer 10 is formed of a firm material having elasticity larger than that of the peel-off sheet 30 adhered to the adhesive layer 10. A length of the peel-off sheet 30 is about 50 cm, and a width of the peel-off sheet 30 is about 5.5 cm, while a length and a width of the surface sheet 20 are set to be smaller than those of the peel-off sheet 30 by about 2 mm, respectively. Incidentally, in FIG. 1C, the surface sheet 20 and the peel-off sheet 30 are illustrated by one line, respectively, for convenience sake.

Figure 1A:
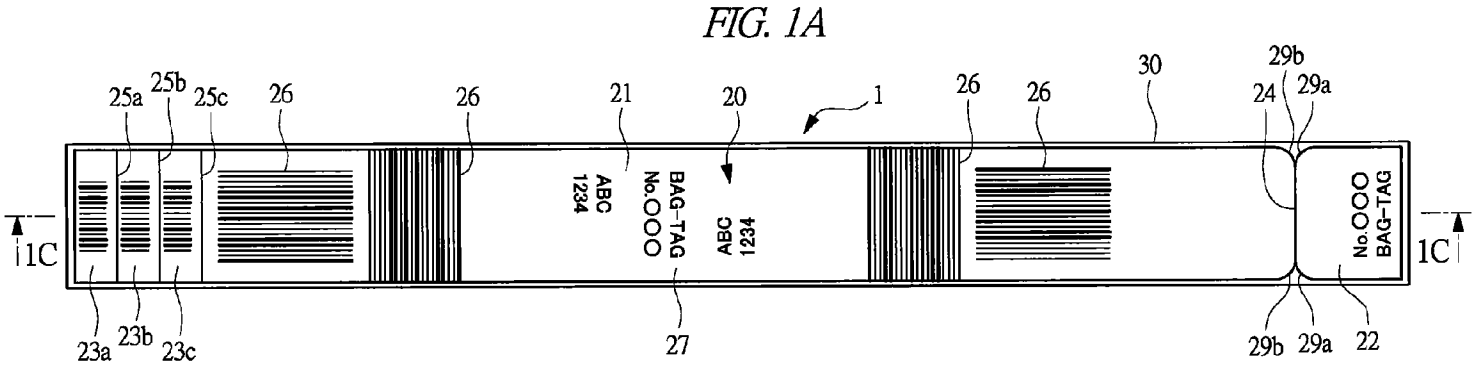
FIG. 1A is a plan view illustrating an outer face of a surface sheet of a luggage tag according to an embodiment of the present invention.

As illustrated in FIG. 1A, the surface sheet 20 has a surface main body portion 21 at a central portion in a lengthwise direction of the surface sheet 20, namely, at a central portion in a longitudinal direction of the surface sheet 20. A customer's copy 22 is provided on a right side of the surface main body portion 21 in FIG. 1A, while three copies for the airline carrier 23*a* to 23*c* are provided on a left side of the surface main body portion 21. The customer's copy 22 is also called "claim tag", and it can be separated from the surface main body portion 21 at a separation slit 24. Luggage information such as an airline carrier name, a flight number, or a luggage number is written on a surface of the claim tag, namely, the customer's copy 22.

On the other hand, the respective copies for the airline carrier 23*a* to 23*c* can be separated from one another at division slits 25*a* to 25*c* and they are separated from the surface main body portion 21 and also separated from the peel-off sheet 30. The luggage information is written on the respective copies for the airline carrier 23*a* to 23*c* as a barcode. One of the three copies for the airline carrier is used as a copy for a reception counter to which the luggage is checked, another one is used as a copy upon transportation of the luggage, and the remaining one is used as a spare. As the copies for the airline carrier, at least two copies may be provided, and the number of the copies for the airline carrier is not limited to three.

In this manner, the band-like surface sheet 20 has the surface main body portion 21 at the central portion thereof, the customer's copy 22 on the one end side thereof, and the copies for the airline carrier 23*a* to 23*c* on the other end side thereof. The customer's copy 22 and the surface main body portion 21 are sectioned by the separation slit 24, the copies for the airline carrier 23*a* to 23*c* are separated from one another by the division slits 25*a* and 25*b*, and the copy for the airline carrier 23*c* and the surface main body portion 21 are separated from each other by the division slit 25*c*. Thus, a continuous region positioned between the separation slit 24 and the division slit 25*c* is the surface main body portion 21.

Figure 2A:
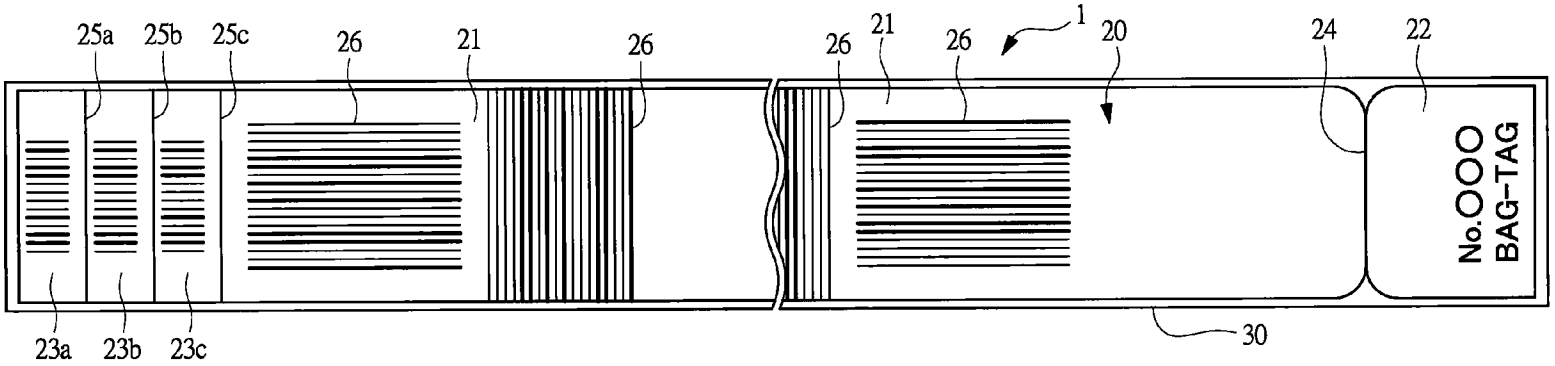
FIG. 2A is a partially-omitted enlarged view of the luggage tag illustrated in FIG. 1A.

As an aspect of the separation slit 24 and the three division slits 25*a* to 25*c*, it is preferable to adopt an aspect in which a user can separate the customer's copy 22 and the copies for the airline carrier 23*a* to 23*c* from the surface main body portion 21 easily. As aspects of such a slit, there are an aspect that a slit is formed of a cut extending entirely in a widthwise direction of the surface sheet 20, namely, extending entirely in a length direction of each slit, and an aspect of a slit where a cut is not provided partially. As the aspect where a cut is not provided partially, an aspect of such a slit having about three non-cut portions having a length of 0.5 mm can be adopted. For example, the separation slit 24 has an aspect where it is formed of a cut extending entirely in the length direction of the slit as illustrated in FIG. 2A, while the division slits 25*a* to 25*c* have an aspect where cuts are not provided partially.

The luggage information is written as barcodes and characters on the outer face of the surface main body portion 21. Two barcode display portions 26 are provided on each end portion of the surface main body portion 21 such that printing directions of the luggage information are perpendicular to each other, and a character display portion 27 displaying the luggage information by characters is provided in a central portion of the surface main body portion 21.

Figure 1B:
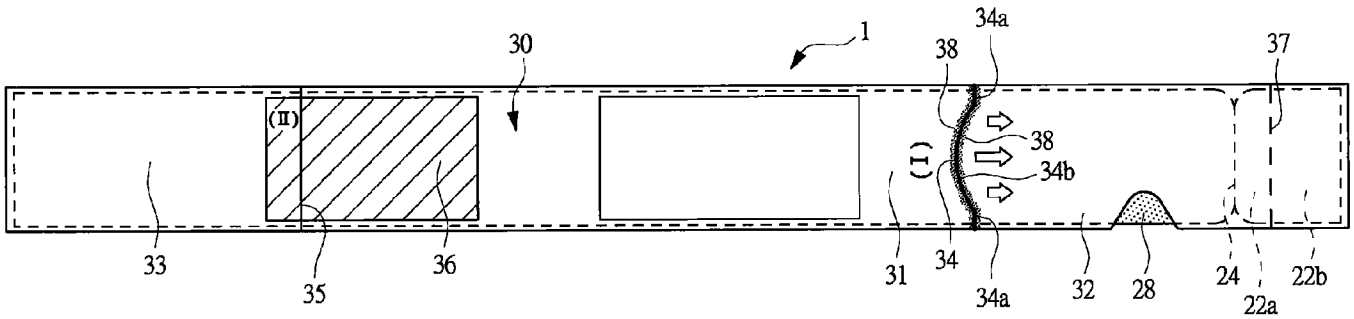
FIG. 1B is a plan view illustrating an outer face of a peel-off sheet of the luggage tag.
Figure 1C:
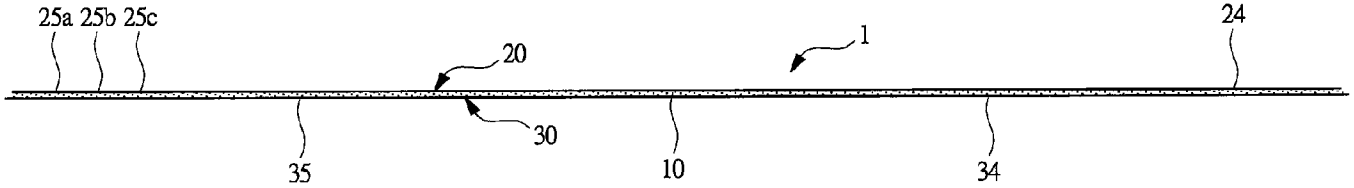
FIG. 1C is a sectional view of the luggage tag taken along the line 1C-1C in FIG. 1A.

As illustrated in FIG. 1B, a central portion of the peel-off sheet 30 in the longitudinal direction is a peel-off main body portion 31, a peel-off region 32 is provided on the right side of the peel-off main body portion 31 in FIG. 1B, namely, on the side of one end portion of the peel-off sheet 30, while a remaining portion 33 is provided on the left side of the peel-off main body portion 31, namely, on the side of the other end portion of the peel-off sheet 30. The peel-off main body portion 31 and the peel-off region 32 are sectioned by a peel-off slit 34, while the peel-off main body portion 31 and the remaining portion 33 are sectioned by a removal slit 35. As shown in FIG. 1B, the peel-off slit 34 and the removal slit 35 are formed of cuts extending entirely in a widthwise direction of the peel-off sheet 30, namely, extending entirely in the lengthwise directions of the slits. The removal slit 35 extends in the widthwise direction of the peel-off sheet 30 straightly, as illustrated in FIG. 1B. On the other hand, the peel-off slit 34 is formed such that both end portions 34*a* thereof in the lengthwise direction are perpendicular to the side edges of the peel-off sheet 30 and a central portion thereof in the lengthwise direction is curved in a direction of projecting toward the peel-off main body portion 31 to form a projection portion 34*b*. Since the projection portion 34*b* is provided at the central portion of the peel-off slit 34 in this manner, when the luggage tag 1 is folded along the peel-off slit 34 such that the peel-off sheet 30 is positioned outside, the projection portion 34*b* is peeled off from the surface sheet 20 in a flip-up style. Thereby, the peel-off region 32 can be easily peeled off from the surface sheet 20.

Figure 3:
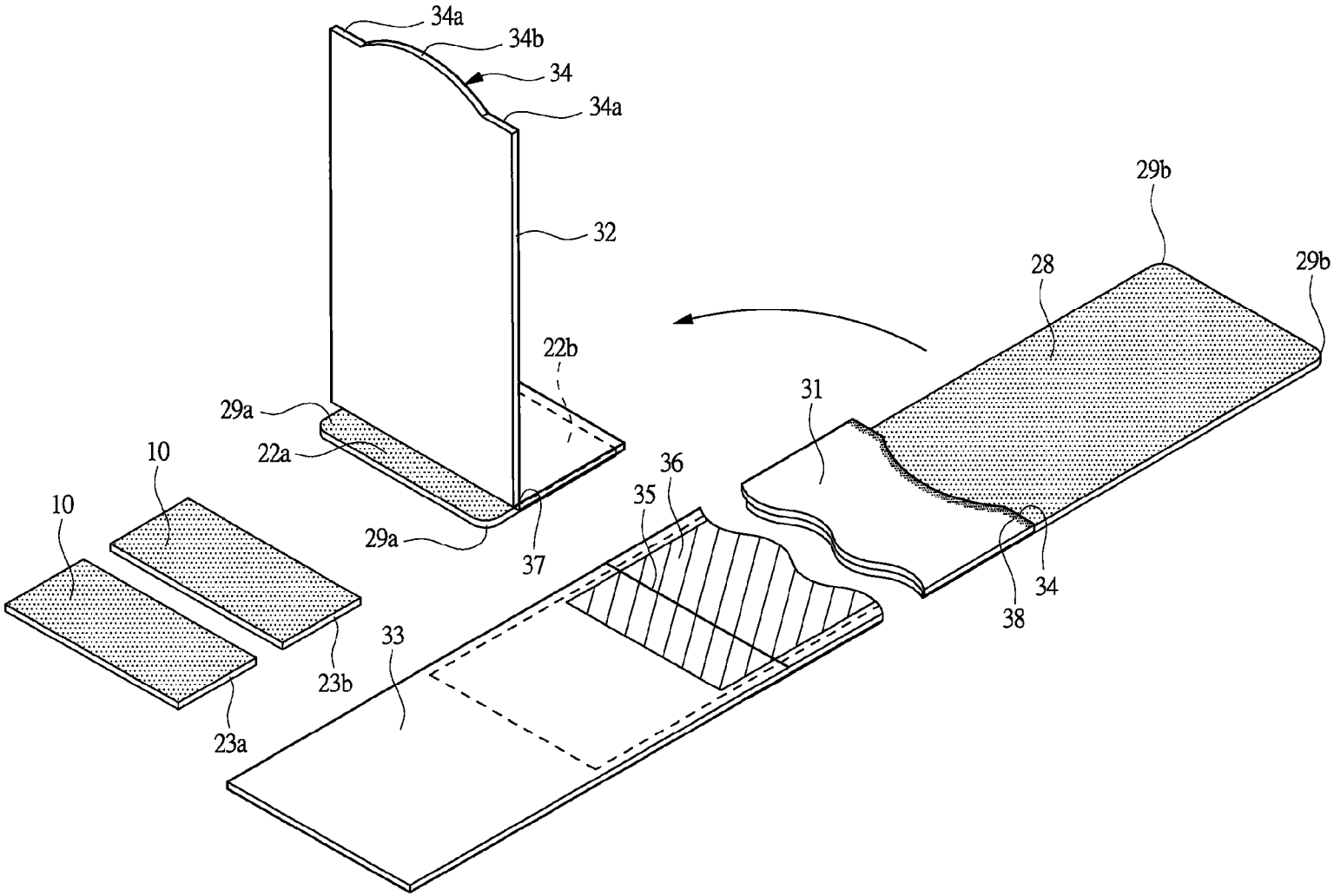
FIG. 3 is a perspective view illustrating the luggage tag put in a state where copies for an airline carrier and the peel-off region have been peeled off from the surface sheet.

In FIG. 1B, the peel-off region 32 is partially cut out, and a portion between the separation slit 24 and the peel-off slit 34 on the back face side of the surface main body portion 21, namely, on the side of the adhesive layer 10 is an attaching portion 28. In this manner, the attaching portion 28 provided on the back face of one end portion of the surface main body portion 21 is covered with the peel-off region 32. The peel-off region 32 is peeled off from the attaching portion 28 while being maintained in a state where the customer's copy 22 is being adhered to the surface side of the peel-off region 32. When the peel-off region 32 is peeled off from the attaching portion 28, as illustrated in FIG. 3, the attaching portion 28 is exposed to the outside.

The attaching portion 28 is adhered to an outer face of the peel-off sheet 30 when the luggage tag 1 is wound on a handle of a luggage in a loop fashion. An attaching region display portion 36 to which the attaching portion 28 exposed is adhered is indicated on the peel-off sheet 30 in order to display the adhering position. As illustrated in FIG. 1B, the attaching region display portion 36 is formed by indicating a contour and hatching in a region defined by the contour. Since the attaching region display portion 36 is provided on the peel-off sheet 30 in this manner, even a luggage owner less attuned to an attaching operation of a tag can adhere the attaching portion 28 to a predetermined position securely.

When a luggage owner checks his/her luggage to an airline carrier upon boarding a flight, the luggage tag 1 is attached to the luggage and the luggage owner receives the customer's copy 22 separated from the luggage tag 1. To separate the customer's copy 22 from the luggage tag 1, as described above, the projection portion 34*b* at the central portion is easily peeled off in a flip-up style by folding the luggage tag 1 along the both end portions of the peel-off slit 34 so that the peel-off slit 30 is positioned outside. Therefore, a user can easily peel off the peel-off region 32 of the peel-off sheet 30 from the attaching portion 28 by holding the projection portion 34*b* with his/her hand. When the peel-off region 32 is peeled off from the attaching portion 28, the customer's copy 22, which is attached to the peel-off region 32, is separated from the surface main body portion 21 while the customer's copy is remaining adhered to the peel-off region 32.

Figure 2B:
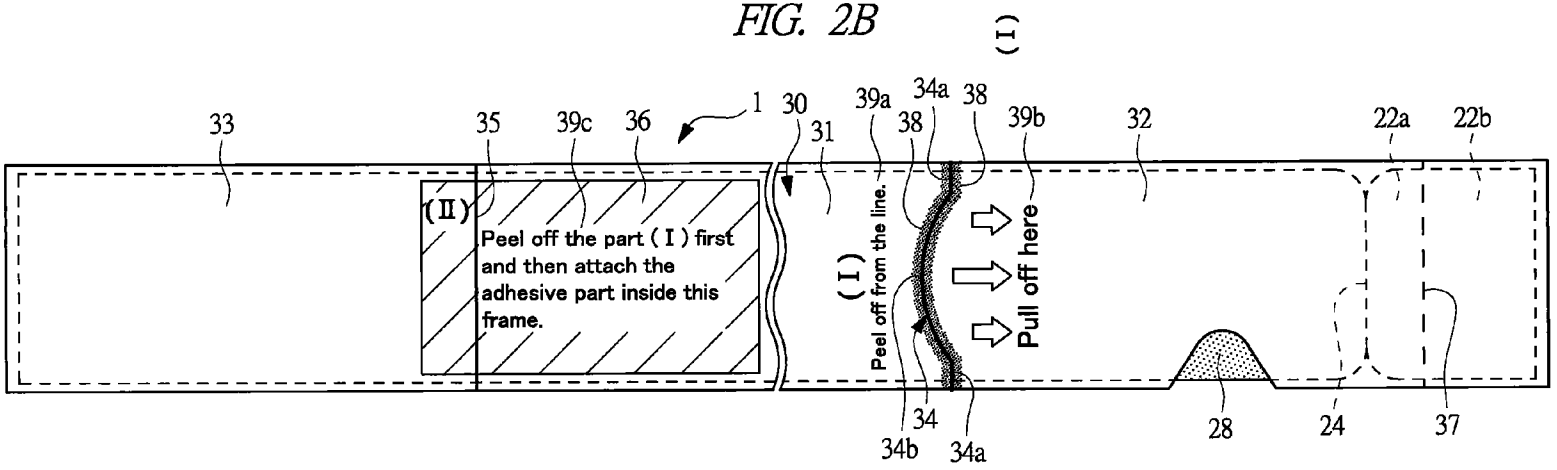
FIG. 2B is a partially-omitted enlarged view of the outer face of the peel-off sheet of the luggage tag illustrated in FIG. 1B.

Since the luggage owner can receive the luggage at the point of arrival by presenting the customer's copy 22, he/she must keep the customer's copy 22 without losing the same. In order to prevent loss of the customer's copy 22, the luggage owner can adhere the customer's copy 22 to one of the user's belongings such as a flight ticket, a diary, or a wallet utilizing the adhesive layer 10 provided on the inner face of the customer's copy 22. For the adhesion, a folding line 37 is formed on the peel-off region 32 at an intermediate position between one end of the customer's copy 22 and a portion corresponding to the separation slit 24 as a line of perforation. When the peel-off region 32 is folded along the folding line 37 such that the peel-off region 32 is positioned outside, as illustrated in FIG. 3, an inner face of the customer's copy 22 partially forms an exposure portion 22*a* exposed to the outside. The remaining portion of the inner face forms an adhesive portion 22*b* to which the peel-off region 32 being folded is adhered. In FIG. 1B and FIG. 2B, a portion positioned on the left side of the folding line 37 is the exposure portion 22*a*, while a portion positioned on the right side of the folding line 37 is the adhesive portion 22*b*.

Figure 4:
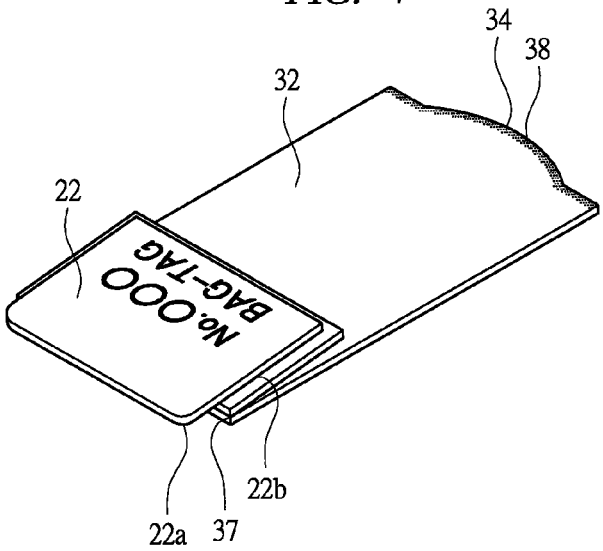
FIG. 4 is a perspective view illustrating a customer's copy which has been attached to one of user's belongings.

FIG. 4 illustrates a state where the customer's copy 22 is attached to one of user's belongings (not illustrated) utilizing the exposure portion 22*a*, where the customer's copy 22 is attached to the one of user's belongings having the peel-off region 32 in a folded state. In this manner, the peel-off region 32 does not lie in the way, and when the luggage owner exchanges the customer's copy 22 for the luggage at the point of arrival, he/she can easily peel off the customer's copy 22 which has been adhered to the one of user's belongings from the one of the user's belongings by pulling up the peel-off region 32.

When the luggage owner separates the customer's copy 22 from the luggage tag 1, as described above, he/she peels the peel-off region 32 from the attaching portion 28 of the surface main body portion 21. At this time, peel-off indication marks 38 are provided on the peel-off sheet 30 on both sides of the peel-off slit 34 along the peel-off slit 34 such that the position of the peel-off slit 34 is displayed to the user and the user can easily find a distal end portion for peeling of the peel-off region 32. The peel-off indication marks 38 are formed by printing lines having a width of about 2 mm on the peel-off sheet 30.

As illustrated in FIG. 1A and FIG. 2A, corner portions 29*a* of the customer's copy 22 positioned on the side of the surface main body portion 21 are formed in an arc shape, and corner portions 29*b* of the surface main body portion 21 positioned on the side of the customer's copy 22 are also formed in an arc shape corresponding to the corners 29*a*. By forming the respective corner portions in the arc shape in this manner, the user can easily perform an operation of pressing the user's finger on any corner portion to separate the customer's copy 22 from the surface main body portion 21.

As an aspect of attaching the luggage tag 1 to a luggage, there are an aspect in which the luggage tag 1 is wound on a handle of the luggage and an aspect in which the luggage tag 1 is directly attached to an outer face of the luggage. When the luggage tag 1 is used in the winding aspect, first, the luggage owner peels the peel-off region 32 of the peel-off sheet 30 off from the surface sheet 20. Next, the luggage owner attaches the attaching portion 28 being exposed in accordance with peeling off of the peel-off region 32 to the attaching region display portion 36 in a state where the luggage tag 1 is being wound on the handle. According to such a two-step operation, the luggage owner can receive the customer's copy 22 and also can wind the luggage tag 1 on the handle of the luggage.

(I) is printed on the peel-off main body portion 31 and characters "Peel off from the line." are printed on a character print portion 39*a* across the peel-off slit 34 such that even a user less attuned to an operation of a series of two steps can easily perform such an operation. Arrows indicating a peeling direction and characters "Pull off here" at a character printing portion 39*b* are printed on the peel-off region 32. Further, (II) is printed and also characters "Peel off the (I) first and then attach the adhesive part inside this frame." at a character print portion 39*c* are printed in the attaching region display portion 36.

On the other hand, when the luggage tag 1 is used in the directly-attaching aspect to a luggage, first, the peel-off region 32 of the peel-off sheet 30 is peeled off from the surface sheet 20 in the same manner as the above-described winding aspect. Thereby, the luggage owner can own the customer's copy 22. Next, the luggage owner peels off the peel-off main body portion 31 from the surface sheet 20 at the portion of the removal slit 35 to remove the same. Thereby, since a portion of the surface main body portion 21 to which the peel-off sheet 30 is being adhered is exposed, the luggage owner adheres the exposed portion to the luggage. Under this situation, since the remaining portion 33 of the peel-off sheet 30 is adhered to the surface sheet 20, the remaining portion 33 is prevented from adhering to the luggage. Therefore, when the luggage owner peels off the luggage tag 1 from the luggage after use, he/she can perform a peeling work of the luggage tag 1 easily by holding the remaining portion 33.

Figure 8A:
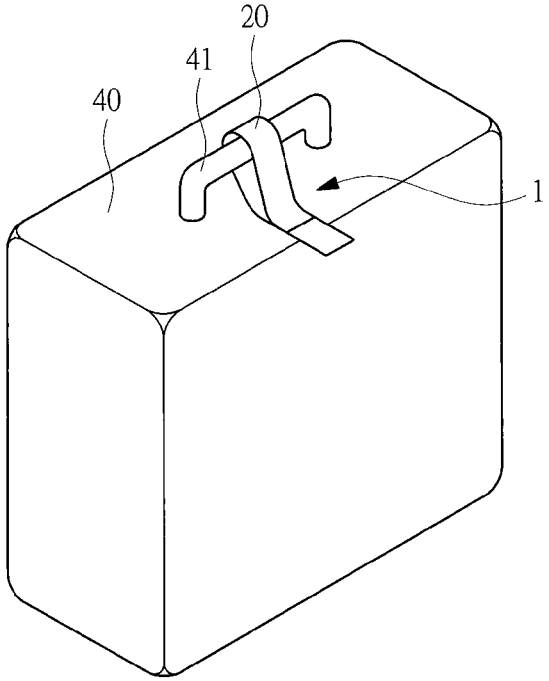
FIG. 8A is a perspective view illustrating a luggage having a handle wound with the luggage tag.

Next, with reference to FIGS. 5 and 6, a procedure of winding the luggage tag 1 on a handle 41 of a luggage 40 will be described, as shown in FIG. 8A. Incidentally, in FIGS. 6A and 6B, the peel-off sheet 30 is illustrated above the surface sheet 20.

Figure 6A:
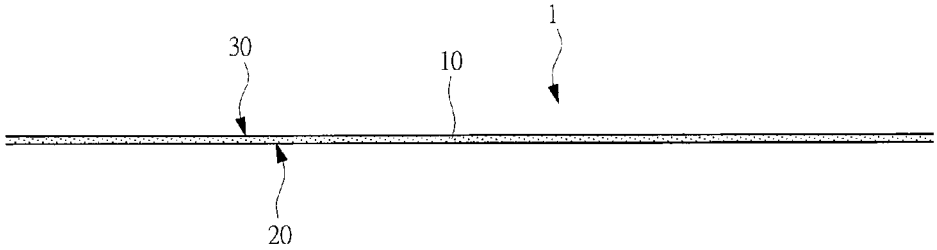
FIG. 6A is a step view illustrating a procedure of winding the luggage tag on a handle of a luggage.
Figure 6B:
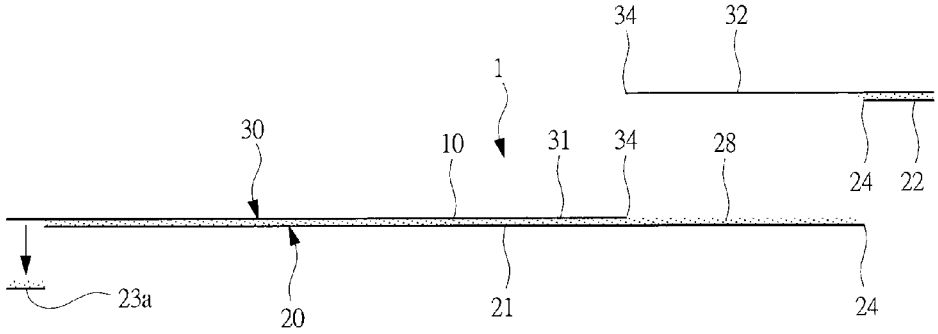
FIG. 6B is a step view illustrating the procedure of winding the luggage tag on the handle of the luggage.

When a luggage is checked in with an airline carrier at a point of departure, as shown in FIG. 6B, the airline carrier's copy 23*a* is peeled off from the peel-off sheet 30 at a luggage counter of the airline carrier. The luggage tag 1 is handed to a customer in the peeled state of the airline carrier's copy 23*a*. A user who received the luggage tag 1 first peels off the peel-off region 32 of the peel-off sheet 30 from the surface sheet 20 from the state illustrated in FIG. 6A to the state as illustrated in FIG. 6B. The peel-off region 32 to which the customer's copy 22 is being attached is peeled off by this peeling off operation and the customer's copy 22 is separated from the surface sheet 20. Since a luggage number is written on an outer face of the customer's copy 22 separated, the luggage number which is written on the surface sheet 20 and the luggage number of the customer's copy 22 can be checked out against each other at the point of arrival. On the other hand, the number of luggage items checked including the destinations and the flight numbers can be collected based on the airline carrier's copies 23*a* at the luggage counter by attaching the airline carrier's copies 23*a* on a cardboard or the like.

Figure 5:
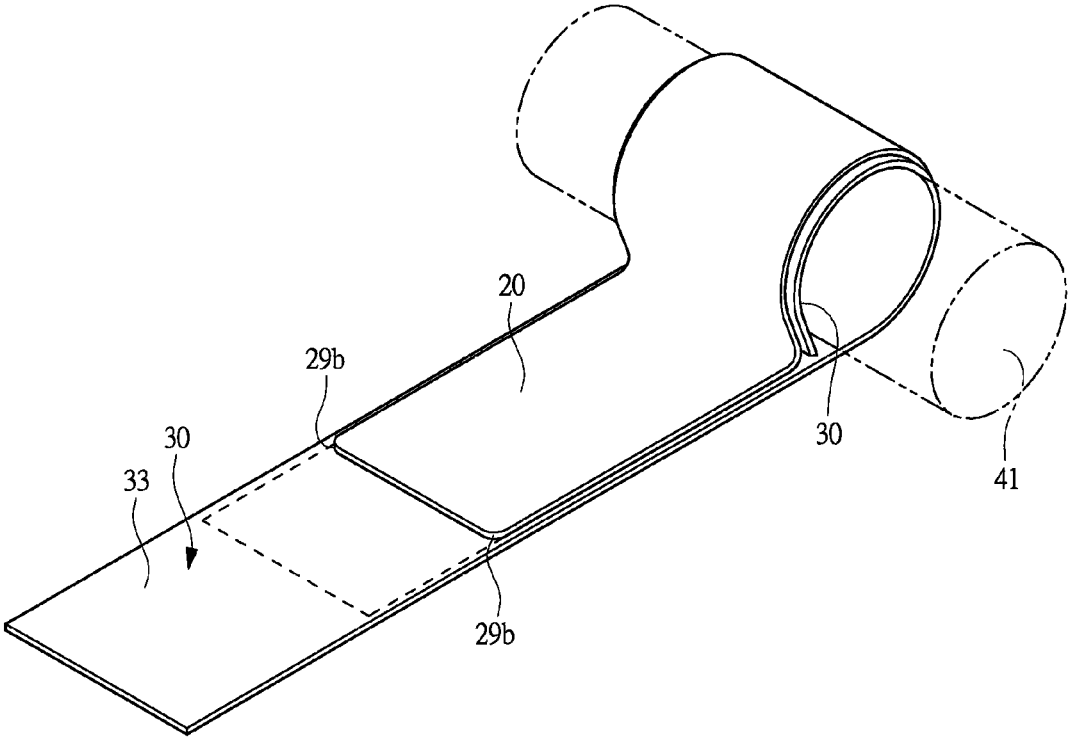
FIG. 5 is a perspective view illustrating the luggage tag in a state of being wound on a handle of a luggage.
Figure 6C:
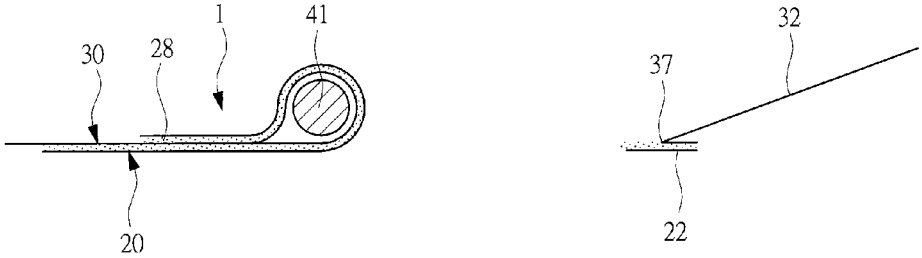
FIG. 6C is a step view illustrating the procedure of winding the luggage tag on the handle of the luggage.

Next, as illustrated in FIGS. 5 and 6C, the user winds the luggage tag 1, from which the airline carrier's copy 23*a* and the peel-off region 32 are peeled off, on the handle 41 of the luggage 40. At this time, as illustrated in FIG. 6C, the user attaches the attaching portion 28 to the peel-off sheet 30 in a state that the luggage tag 1 is being wound through the handle 41. Thereby, the user attaches the luggage tag 1 to the handle 41. When the user attaches the attaching portion 28 to the peel-off sheet 30, as illustrated in FIG. 1B, even if he/she is less attuned to an attaching operation of the luggage tag 1, he/she can guess or understand the attaching position of the attaching portion 28 easily to accurately attach the attaching portion 28 at the position of the attaching region display portion 36 because the attaching region display portion 36 is provided on the peel-off sheet 30. The user can attach the luggage tag 1 to the handle 41 of the luggage 40 easily according to the two-step operation of the peeling operation of the peel-off region 32 and the attaching operation of the attaching portion 28 exposed to the attaching region display portion 36 in this manner.

Figure 7A:
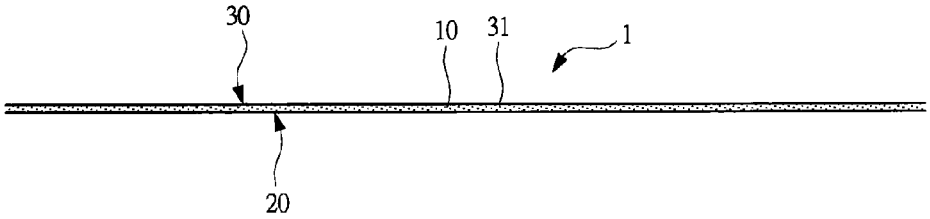
FIG. 7A is a process drawing illustrating a procedure of attaching the luggage tag on a side face of a luggage.
Figure 7B:
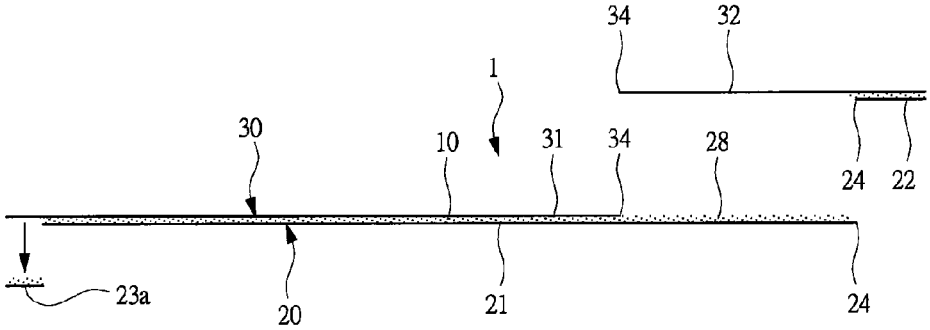
FIG. 7B is a process drawing illustrating the procedure of attaching the luggage tag on the side face of the luggage.
Figure 7C:
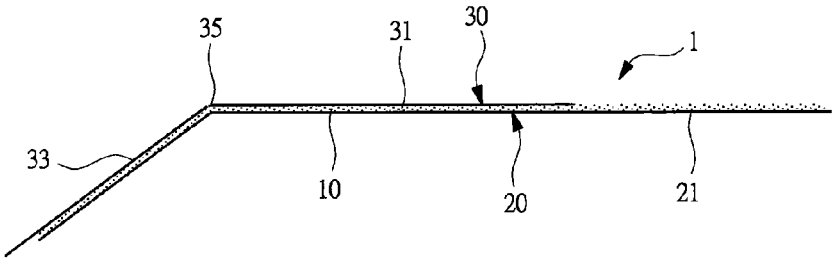
FIG. 7C is a process drawing illustrating the procedure of attaching the luggage tag on the side face of the luggage.
Figure 7D:
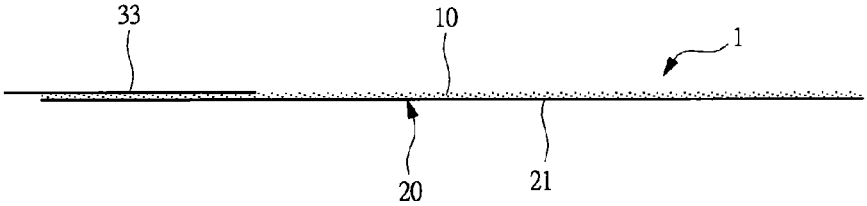
FIG. 7D is a process drawing illustrating the procedure of attaching the luggage tag on the side face of the luggage.
Figure 8B:
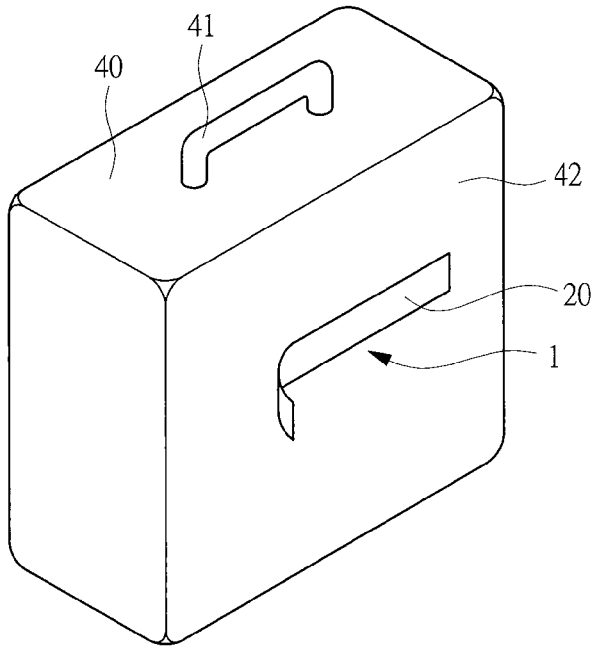
FIG. 8B is a perspective view illustrating a luggage having a side face attached with the luggage tag.

Next, as illustrated in FIG. 8B, the procedure of attaching the luggage tag 1 to a side face 42 of the luggage 40 will be described with reference to FIG. 7.

As illustrated in FIGS. 7A and 7B, the user peels off the peel-off region 32 of the peel-off sheet 30 from the surface sheet 20 in the same manner as the usage aspect illustrated in FIGS. 6A to 6C. According to the peeling off operation, the peel-off region 32 to which the customer's copy 22 is being adhered is peeled off and the customer's copy 22 is separated from the surface sheet 20. Next, as illustrated in FIG. 7C, the user folds the peel-off sheet 30 centering the removal slit 35 such that the peel-off sheet 30 is positioned outside. When the peel-off sheet 30 is folded as illustrated in FIG. 7C, peeling off is performed such that the left end portion of the peel-off main body portion 31 flips up from the adhesive layer 10. Thereby, the user peels off and removes the peel-off main body portion 31 from the surface sheet 20 by holding the peeled off portion in his/her hand. FIG. 7D illustrates a state where the peel-off main body portion 31 his peeled off and removed. When the user performs the peeling off and removing operations, the adhesive layer 10 provided on the inner face of the surface sheet 20 is exposed while a portion covered with the remaining portion 33 is being left, as illustrated in FIG. 7D. The user attaches the luggage tag 1 to the luggage 40 by attaching the adhesive layer 10 exposed to the side face 42 of the luggage 40, as illustrated in FIG. 8B. Since the remaining portion 33 is left at the end portion of the surface sheet 20 in this state, the surface sheet 20 is not entirely attached to the luggage, so that he/she can easily peel off the luggage tag 1 starting from a portion of the remaining portion 33 when the user removes the luggage tag 1 from the luggage after use. When the user attaches the luggage tag 1 to the side face 42 of the luggage 40 in this manner, he/she must further perform the removing operation of the peel-off main body portion 31 as compared with the case where the luggage tag 1 is wound on the handle 41, but he/she can easily attach the luggage tag 1 to the luggage 40 only by attaching the exposed adhesive layer 10 to the side face 42.

The present invention is not limited to the above-described embodiment, and it may be modified variously without departing from the scope and the gist of the present invention. For example, if a non-contact type IC module is attached to an inner face of the surface sheet 20, the tag of the present invention can be used as an RFID luggage tag.

What is claimed is:

1. A luggage tag to be attached to a luggage, the luggage tag comprising:

a band-like surface sheet provided with an outer face on which luggage information is printed and an inner face having an adhesive layer;

a band-like peel-off sheet detachably adhered to the adhesive layer;

a customer's copy provided on one end portion of the surface sheet to be separable at a separation slit from a surface main body portion of the surface sheet;

a plurality of airline carrier's copies provided on the other end portion of the surface sheet so as to be peeled off from the peel-off sheet and divided at division slits from the surface main body portion;

a peel-off region provided on one end portion of the peel-off sheet so as to be separated at a peel-off slit from a peel-off main body portion of the peel-off sheet and also peeled off from an attaching portion provided on the surface main body portion while the customer's copy is being attached to the peel-off region; and a folding line provided on the peel-off region at an intermediate position between an end of the peel-off sheet and the separation slit so that an adhesive layer of the customer's copy is sectioned into an adhesive portion to which the peel-off region is adhered and an exposure portion from which the adhesive layer is exposed;

wherein, when winding the surface main body portion on a handle of the luggage in a loop fashion, the attaching portion is attached onto the surface main body; and the exposure portion is exposed by folding the peel-off region at the folding line.

2. The luggage tag according to claim 1, wherein the other end portion of the peel-off sheet is defined as a remaining portion, a removal slit for sectioning the peel-off sheet into the remaining portion and the peel-off main body portion is provided in the peel-off sheet, and the peel-off main body portion is removed from the surface sheet when attaching the surface sheet to the luggage.

3. The luggage tag according to claim 1, wherein a projecting portion curved so as to project toward the peel-off main body portion from both end portions of the peel-off slit is provided on a central portion of the peel-off slit in a longitudinal direction of the peel-off slit, and the projecting portion is peeled off from the attaching portion when the luggage tag is folded along the both end portions of the peel-off slit such that the peel-off sheet is positioned outside.

4. The luggage tag according to claim 1, wherein a peel-off indication mark indicating a position of the peel-off slit is provided on the peel-off sheet.

5. The luggage tag according to claim 1, wherein corner portions of the customer's copy positioned on the surface main body portion side and corner portions of the surface main body portion positioned on the customer's copy side are formed in an arc shape, respectively.

* * * * *